United States Patent [19]

Gratton

[11] 4,421,275

[45] Dec. 20, 1983

[54] APPARATUS FOR APPLYING REFRACTORY MATERIAL TO REFRACTORY LINED VESSELS

[76] Inventor: Richard A. Gratton, 34 Thorn St., Sewickley, Pa. 15143

[21] Appl. No.: 293,604

[22] Filed: Aug. 17, 1981

[51] Int. Cl.[3] ..... B05B 3/12

[52] U.S. Cl. ..... 239/226

[58] Field of Search ..... 239/226, 227; 266/281; 118/317, 323, 307

[56] References Cited

U.S. PATENT DOCUMENTS

| | | | |
|---|---|---|---|
| 2,840,973 | 8/1958 | O'Callaghan | 118/317 |
| 3,797,745 | 3/1974 | Haus | 239/227 |
| 4,043,295 | 8/1977 | Speck | 118/317 |
| 4,099,708 | 7/1978 | Morris et al. | 239/227 X |
| 4,167,246 | 9/1979 | Haus | 239/227 |
| 4,211,367 | 7/1980 | Allison | 239/226 |

FOREIGN PATENT DOCUMENTS

| | | | |
|---|---|---|---|
| 2849159 | 5/1979 | Fed. Rep. of Germany | 239/226 |

*Primary Examiner*—John J. Love
*Assistant Examiner*—Paul A. Sobel
*Attorney, Agent, or Firm*—Robert D. Yeager

[57] ABSTRACT

Apparatus for applying refractory material to the interior surfaces of vessels adapted to contain molten metal. A pair of concentric conduits separately convey refractory material and water; the inner conduit is stationary and carries the refractory; the outer conduit rotates and carries the water.

2 Claims, 6 Drawing Figures

APPARATUS FOR APPLYING REFRACTORY MATERIAL TO REFRACTORY LINED VESSELS

BACKGROUND OF THE INVENTION

1. Field of the Invention

This invention relates to apparatus for applying refractory material to the interior surfaces of vessels adapted to contain molten metal.

2. Description of the Prior Art

In the metallurgical art, it is common practice to patch or supplement the refractory linings of vessels adapted to contain molten metal while such vessels remain in service. Typical of the vessels to which such practice is applied are open-top hot metal ladles. In the steel industry, for example, large refractory-lined vessels are used to receive a heat of steel from the refining furnace and move the molten steel into position for pouring it into a continuous casting machine or into conventional ingot molds. During these operations, wear on the refractory lining of the ladle tends to be uneven; the service life of that lining may be prolonged by performing selective patching or lining supplementation without removing the ladle completely from service for a lining replacement.

Workers in the art have recognized the desirability of providing mechanical means for accomplishing these patching procedures; the principal advantage is time-saving, but awkward manual operations performed in a high temperature setting also may be eliminated by mechanical apparatus designed to propel a pasty refractory material against the refractory walls of a vessel. Haus U.S. Pat. No. 3,797,745 represents an early attempt at providing a mechanical refractory applicator. That patent discloses an arrangement of two concentric tubes suspended from above the ladle mouth and having rotatable discharge nozzles connected to the conduits at their lower ends for mixing dry refractory material and water passed through the outer and inner conduits, respectively, and applying the mixture to the interior walls of the ladle. The apparatus of U.S. Pat. No. 3,797,745 requires, however, that the lower portions of both conduits rotate relative to their upper portions. This rotation is achieved by the use of a rotary coupling immediate the ends of each conduit. The fact that both conduits rotate narrowly restricts any tolerance for longitudinal misalignment in the structure and this limitation is manifested in higher manufacturing and assembly costs as well as in frequent maintenance during operation.

A further problem associated with the apparatus of U.S. Pat. No. 3,797,745 is that the refractory material is conveyed through the annular passageway between the inner and outer conduits while water is conveyed through the inner conduit. In practice, the abrasion of the granular refractory material on the outer wall of the water-carrying inner conduit results in frequent breakthroughs in those outer walls and consequent shutdowns to replace the inner conduit. Further, the operation of the apparatus is dependent upon the relatively equal division of flow of refractory material between the two discharge nozzles at the bottom of the apparatus. Flow of refractory in the annular passageway between the conduits is not conductive to achieving such equal division.

Another arrangement for applying granular refractory material to the linings of ladles and the like is shown in U.S. Pat. No. 4,099,708. This arrangement is directed largely to the selective application of refractory on lining walls. As in U.S. Pat. No. 3,797,745, the apparatus includes two concentric conduits which rotate together; however, the conveyance of materials is reversed in that refractory material flows in the inner conduit and water flows in the annulus between the conduits. Nevertheless, the same structural and operating problems associated with two rotating concentric conduits that are discussed above with respect to U.S. Pat. No. 3,797,745 are present in the '708 apparatus.

A more recent attempt to devise a refractory applicator is shown in Haus U.S. Pat. No. 4,167,246. That apparatus reveals an abandonment of the two concentric conduits concept in favor of a single rotating conduit for conveying refractory material with the water being supplied externally of the applicator through flexible hoses. As a result, the '246 device is incapable of continuous rotation.

SUMMARY OF THE INVENTION

The present invention is directed to apparatus for applying refractory material to the interior surfaces of a vessel by the rotation of discharge nozzles located at the lower ends of concentric conduits which feed the nozzles. Unlike the known apparatus directed to a similar purpose, the present invention solves the problems associated with concentric conduits by providing for rotation of only the outer conduit; the inner conduit is stationary and thus certain heretofore unavailable features and advantages are realized.

The present invention provides, in an apparatus for applying refractory material to the interior surfaces of a vessel adapted to contain molten metal, the apparatus including a pair of concentric conduits for separately conveying granular refractory material and water to at least one rotatable discharge nozzle for mixing therein and application to those surfaces thereby, the improvement comprising: a stationary inner conduit for conveying the granular refractory material; an outer conduit concentrically disposed about the inner conduit, thereby forming an annular passageway therebetween for conveying the water and being rotatable about the inner conduit; and the discharge nozzle being rotatable with the outer conduit.

It will be understood that the term "water" as used herein includes any suitable agent for wetting the dry granular refractory material to form a pasty mixture that will adhere to refractory-lined surfaces.

Other details and advantages of the present invention will become apparent from a consideration of the following detailed description, taken with the accompanying drawings.

DETAILED DESCRIPTION OF THE PREFERRED EMBODIMENTS

Figure 1:
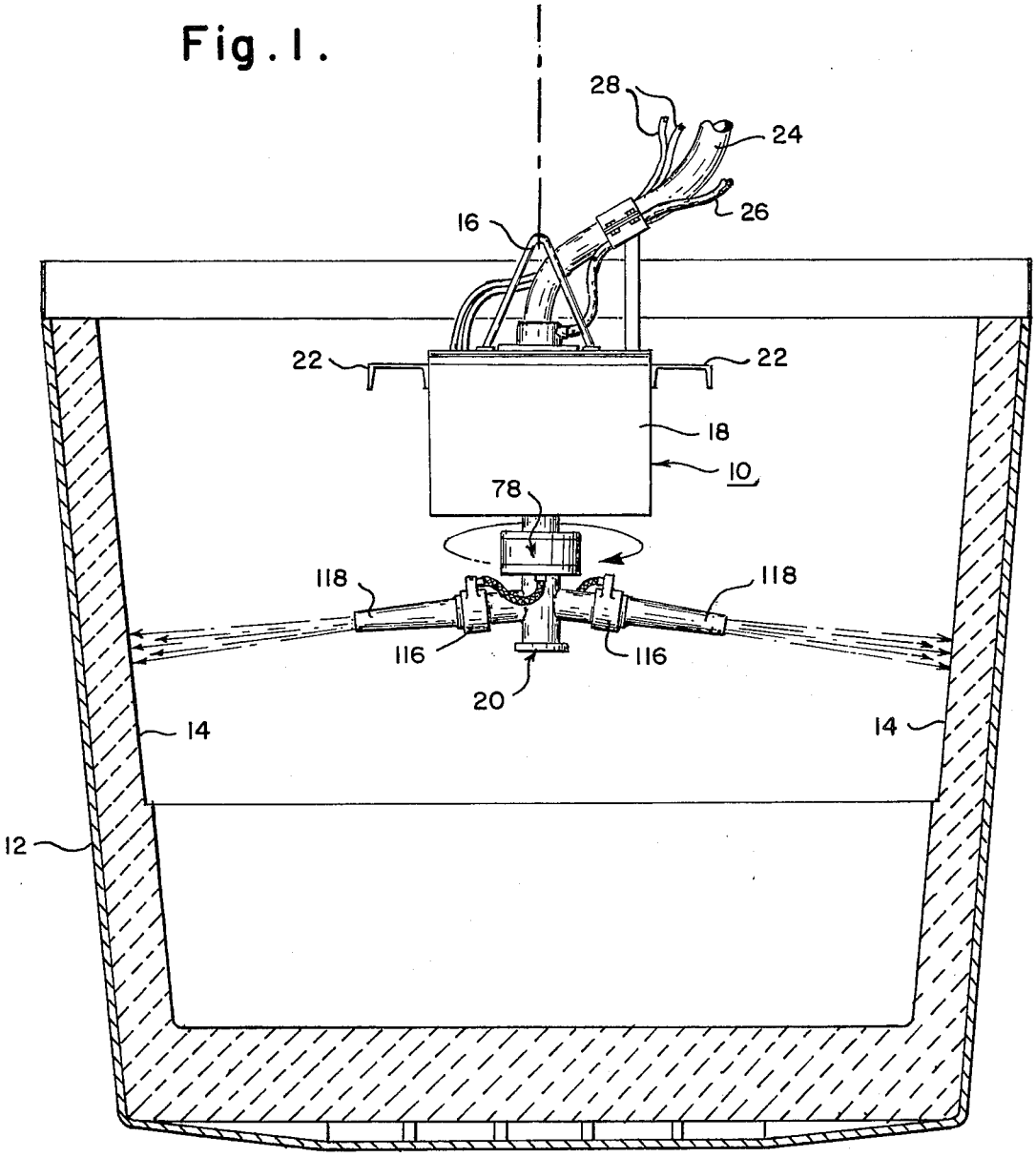
FIG. 1 is an elevational view, partly in section, illustrating the present invention in use within the open-top, refractory-lined ladle.
Figure 2:
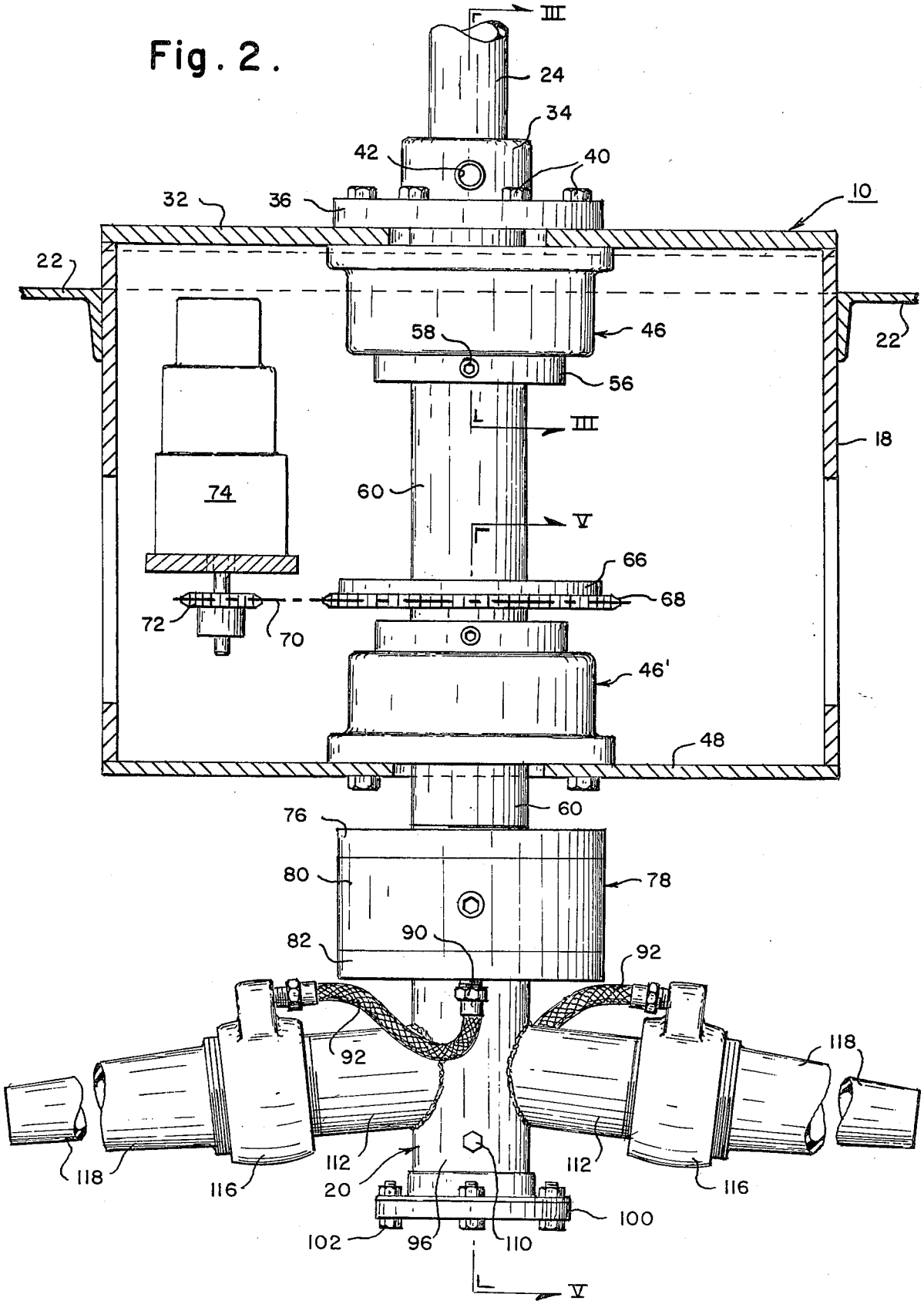
FIG. 2 is an enlarged view, partly in elevation and partly in section, of a refractory applicator embodying the present invention.

Referring to the drawings, there is shown in FIG. 1 a refractory applicator, generally designated by the reference numeral 10, embodying the present invention and in position within an open-top ladle 12 for applying granular refractory to the refractory-lined walls 14 of ladle 12. Applicator 10 is suspended from above by means of a crane or other lifting device (not shown) which hooks onto eye 16 and thereby is able to raise and lower applicator 10 as required. Applicator 10 includes a main housing 18 and a nozzle assembly 20. A pair of lifting ears 22 are attached to main housing 18 to permit manipulation of applicator 10 by a suitable lifting device during transport and maintenance. Granular refractory material and water are fed to nozzle assembly 20 through flexible material hose 24 and water hose 26, respectively. Compressed air, for driving an air motor within housing 18, is passed into housing 18 through lines 28.

Figure 3:
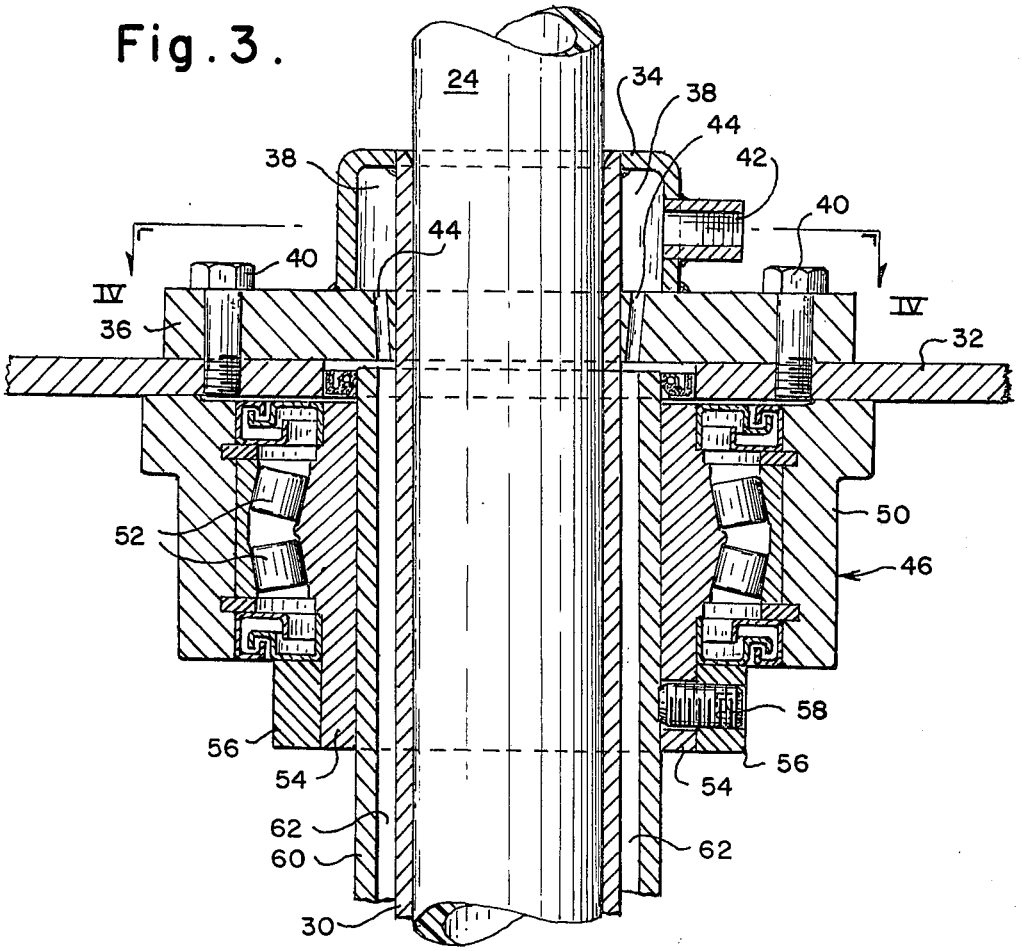
FIG. 3 is a transverse sectional view, partly in elevation, of the upper portion of the applicator of FIG. 2, taken on the line III—III thereof.
Figure 4:
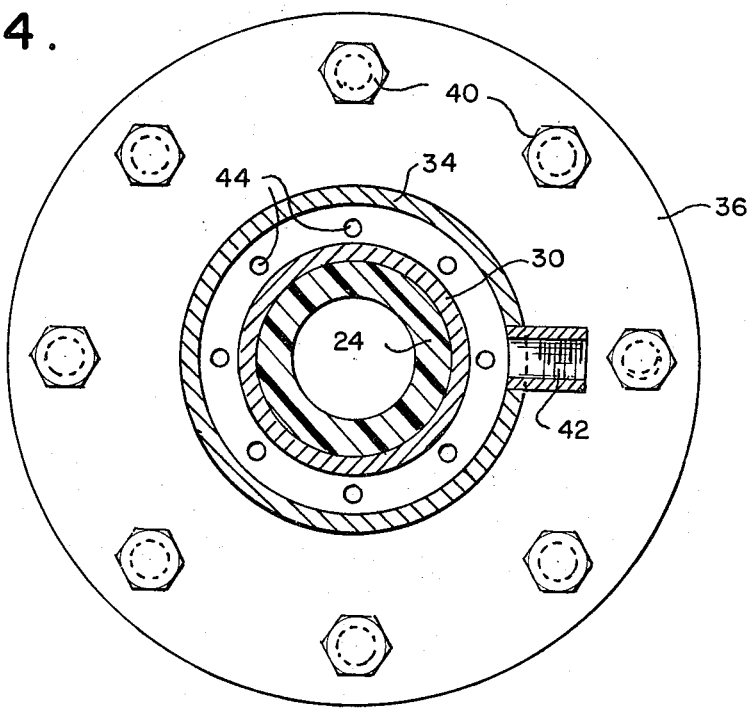
FIG. 4 is a sectional view, partly in elevation, taken on the line IV—IV of FIG. 3.

The detailed structure of applicator 10 will be described by reference to FIGS. 2–6. Material hose 24 passes into housing 18 through its top and makes snug engagement with a vertically arranged, stationary inner conduit 30. Although flexibility is desired in the portion of material hose 24 that projects above housing 18, the portion of material hose 24 within inner conduit 30 may be formed of steel or ceramic material for increased wear resistance. Inner conduit 30 projects above the top cover 32 of housing 18; there inner conduit 30 is surrounded by a cap member 34 and an attached flange 36. As best shown in FIG. 3, a portion of projecting inner conduit 30, cap member 34 and a top surface portion of flange 36 form an annulus which will be referred to as water inlet manifold 38. Flange 36 is secured to the top cover 32 of housing 18 by bolts 40; a flexible gasket may be inserted between flange 36 and top cover 32 to provide some adjustability in the alignment of inner conduit 30. Water is introduced into water inlet manifold 38 through fitting 42 which is connected to water hose 26. For reasons to be described hereinafter, flange 36 includes a series of inwardly inclined flow passages 44.

A self-aligning bearing assembly 46 is bolted (not shown) to the bottom of top cover 32 of main housing 18. An identical bearing assembly 46' is bolted to the bottom cover 48 of housing 18 in an inverted position with respect to bearing 46. Bearing assemblies 46, 46' are axially aligned with the longitudinal axis of stationary inner conduit 30.

Bearing assembly 46 is of conventional construction and includes a stationary outer race with associated rollers 52 and a rotatable inner race 54. A collar 56 is force-fit on the lower portion of inner race 54. Set screw 58 extends through collar 56 and inner race 54 for purposes soon to be described.

Extending downwardly from a point slightly beneath the top surface of top cover 32 and concentrically arranged about inner conduit 30 is an outer conduit 60. Set screw 58 engages the exterior surface of outer conduit 60 and thus outer conduit 60 is supported for rotation about stationary inner conduit 30 by bearing assemblies 46, 46'. An annulus 62, in fluid communication with flow passages 44 in flange 36, is formed between stationary inner conduit 30 and rotatable outer conduit 60 to permit the further downward passage of water within applicator 10. A seal member 64 is provided in the central opening in top cover 32 to prevent the radially outward escape of water flowing through flow passages 44 and into annulus 62.

Rotation of outer conduit 60 is accomplished in the following manner (see FIG. 2): Flange 66 is welded to outer conduit 60 at a point between bearing assemblies 46, 46'; sprocket 68 is mounted to flange 66. Chain 70 extends between sprocket 68 and the drive sprocket 72 of air motor 74, and upon actuation of motor 74 by the passage of compressed air through air lines 28, outer conduit 60 may be rotated in either direction.

Figure 5:
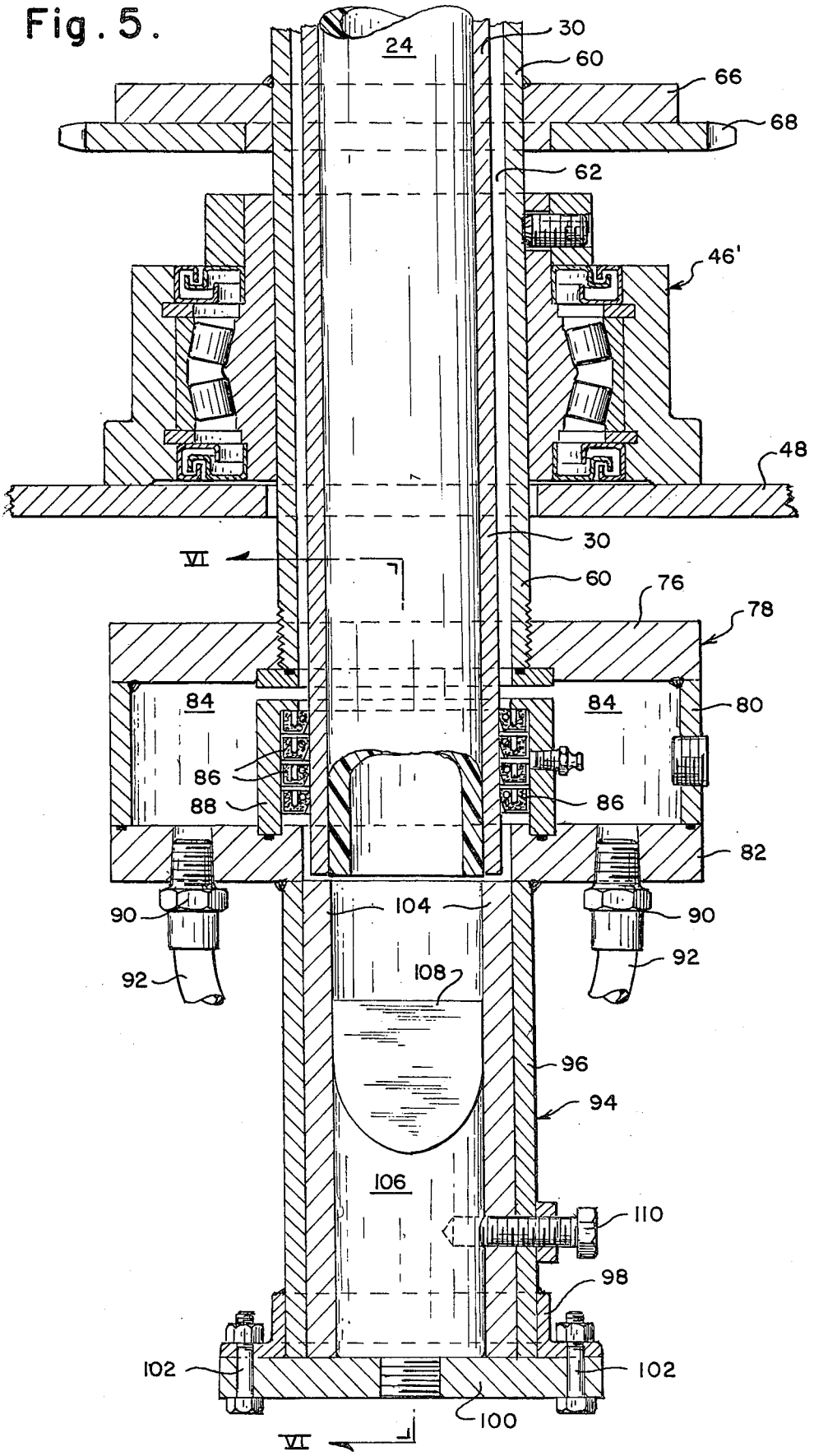
FIG. 5 is a transverse sectional view, partly in elevation, of the lower portion of the applicator of FIG. 2, taken on the line V—V thereof.
Figure 6:
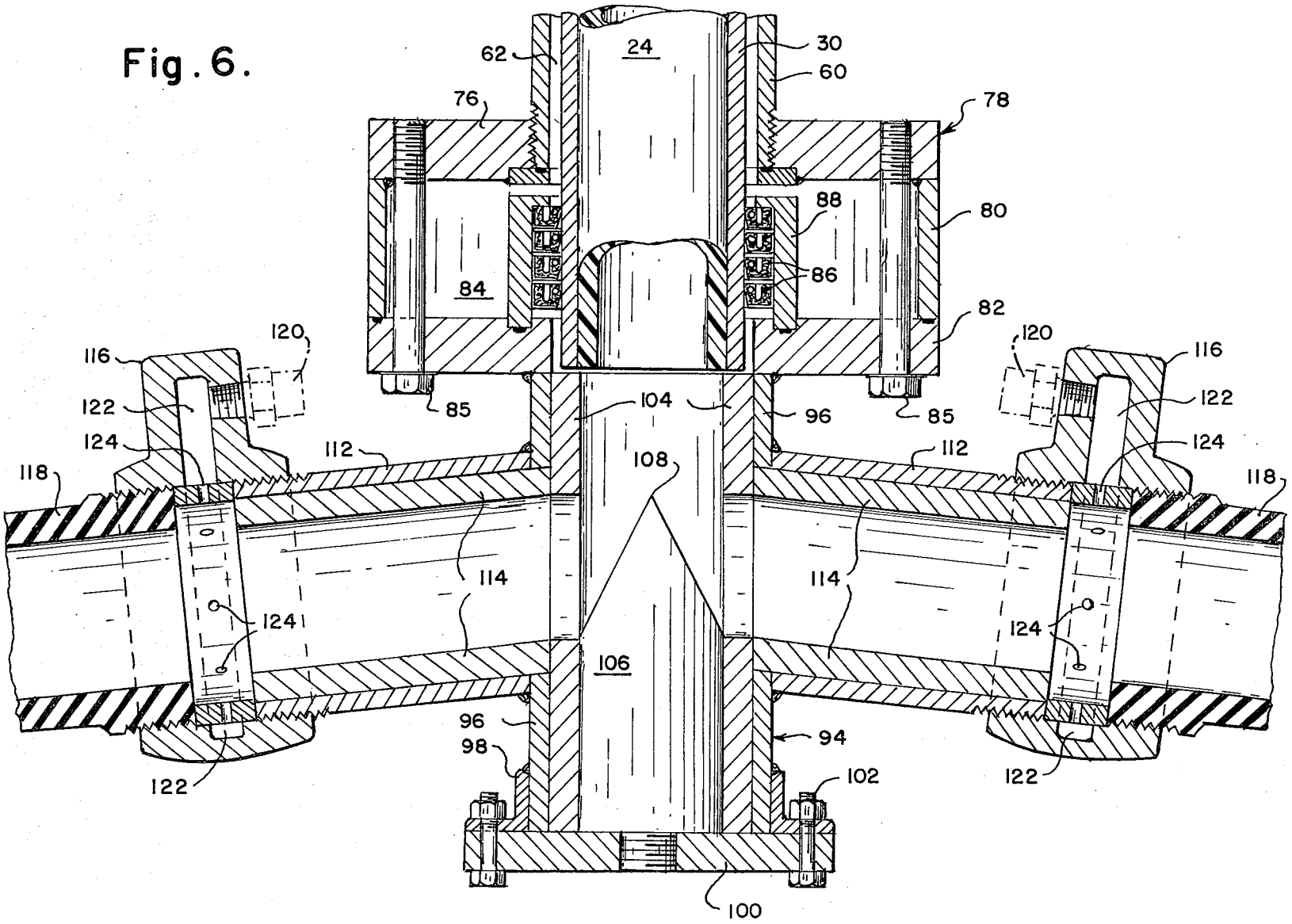
FIG. 6 is a sectional view, partly in elevation, taken along the line VI—VI of FIG. 5.

Referring now to FIGS. 5 and 6, nozzle assembly 20 will now be described. The lower end of outer conduit 60 is threaded to engage the upper plate 76 of water distribution manifold 78. In addition to upper plate 76, water distribution manifold 78 is formed of a cylindrical side wall 80 and bottom plate 82, thereby to form an annulus 84 which receives water flowing downwardly in annulus 62. Water distribution manifold 78 is secured by bolts 85 after the placement of appropriate O-ring seals to prevent water leakage. Seal members 86, confined by seal retainer 88, engage an exterior, preferably polished, surface portion of inner conduit 30 to prevent the downward escape of water past the lower end of inner conduit 30. As best shown in FIG. 5, stationary inner conduit 30 and its associated material hose 24 terminate just slightly short of the lower surface of bottom plate 82 of water distribution manifold 78 to provide the necessary clearance for rotation of water distribution manifold 78, with outer conduit 60, about inner conduit 30. With the structure just described, water flowing downwardly in annulus 62 enters water distribution manifold 78, flows out through fittings 90, and passes through flexible hoses 92.

Nozzle assembly 20 also includes a refractory material flow splitter assembly 94 mounted beneath water distribution manifold 78 and in axial alignment with inner conduit 30. Flow splitter assembly 94 also rotates with the rotation of outer conduit 60 through a rigid connection with water distribution manifold 78.

Flow splitter assembly 94 includes a tubular member 96 welded to bottom plate 82 of water distribution manifold 78, an L-shaped flange member 98 secured to tubular member 96 and a cap member 100 secured to flange member 98 by means of bolts 102. Tubular member 96 is lined with an appropriate wear-resistant material 104 such as steel or ceramic. Disposed within flow splitter assembly 94 is an upstanding flow splitter 106 having a wedge-shaped top portion 108. Flow splitter 106 is of conventional design. Flow splitter 106 is indexed in correct orientation by means of bolt 110.

Referring to FIG. 6, nozzle assembly 20 also includes a pair of opposed arms 112 extending at a slight downward angle from openings in tubular member 96 that are aligned with the inclined faces of wedge-shaped top portion 108 of flow splitter 106. It thus may be seen that granular refractory material flowing downwardly in material hose 24 will impact one or the other of the inclined faces of flow splitter 106 and will be projected into the corresponding flow passage of the adjacent arm 112. Arms 112 are lined with a suitable wear-resistant material 114. By reason of their rigid attachment to tubular member 96, arms 112 rotate with the rotation of outer conduit 60.

Threadedly attached to the outer ends of arms 112 are conventional water bodies 116 which, in turn, threadedly receive the inlet ends of conventional nozzles 118. Water bodies 116 are connected to water distribution manifold 78 by flexible hoses 92. Water thus flows into water bodies 116 through inlet fittings 120 and circulates in water bodies 116 through annuli 122. The circulating water flows radially inwardly through openings 124 in water bodies 116 and into the path of granular refractory material flowing therethrough. The pasty mixture formed by the mixing of the granular refractory and water is applied to surfaces at which nozzles 118 are directed as they rotate (see FIG. 1).

In operation, therefore, dry granular refractory material, carried in suspension in a carrier gas such as compressed air, is introduced into material hose 24. Water under pressure is introduced into water line 26. The two materials are conveyed separately through applicator 10 and are mixed, all as described above, for application to the refractory lining of a vessel.

The structure of the present invention offers significant advantages over conventional refractory applicators. The fact that inner conduit 30 is stationary minimizes the alignment problems associated with two concentric rotating conduits; further the apparatus inherently is simplified by the elimination of parts, such as rotary couplings, required to effect simultaneous rotation of the conduits. Still further, the stationary inner conduit 30 may be easily removed from applicator 10, i.e. by the removal of flange 36 from housing 18; seal maintenance also is facilitated by this feature. The fact that the inner conduit is used for conveying refractory material permits unobstructed flow of that material against the flow splitter with the result that equal flow division between the discharge nozzles is achieved.

It also may be seen that the structure of the present invention permits the flow of water in annulus 62 to act as a coolant for bearing assemblies 46, 46' and for the lower seals 86. Considering the high temperature environment in which applicator 10 normally operates, this cooling feature is an unexpected benefit of the structure of the present invention.

What is claimed is:

1. In an apparatus for applying refractory material to the interior surfaces of a vessel adapted to contain molten metal, said apparatus including a pair of concentric conduits for separately conveying granular refractory material and water to at least one rotatable discharge nozzle for mixing therein and application to said surfaces thereby, the improvement comprising:

a stationary inner conduit for conveying said granular refractory material;

an outer conduit concentrically disposed about said inner conduit, thereby forming an annular passageway therebetween for conveying said water, and being rotatable about said inner conduit;

sealing means disposed between said conduits at a location along the discharge end portion of said stationary inner conduit; and said discharge nozzle being rotatable with said outer conduit and being in communication with said inner and outer conduits.

2. The improvement recited in claim 1 wherein:

said sealing means is in heat exchange relationship with said water conveyed in said annular passageway.

* * * * *